US005555992A

United States Patent [19]

Sedgeley

[11] Patent Number: 5,555,992

[45] Date of Patent: Sep. 17, 1996

[54] DOUBLE HINGED OPENING FOR CONTAINER END MEMBERS

[75] Inventor: William A. Sedgeley, Golden, Colo.

[73] Assignee: Coors Brewing Company, Golden, Colo.

[21] Appl. No.: 393,140

[22] Filed: Feb. 21, 1995

Related U.S. Application Data

[63] Continuation-in-part of Ser. No. 276,331, Jul. 15, 1994.

[51] Int. Cl.[6] ..... B65D 17/34

[52] U.S. Cl. ..... 220/269; 220/270; 220/271; 220/273; 220/906

[58] Field of Search ..... 220/269, 271, 220/276, 273, 906

[56] References Cited

U.S. PATENT DOCUMENTS

| | | | |
|---|---|---|---|
| 3,977,561 | 8/1976 | Strobe et al. . | |
| 4,015,744 | 4/1977 | Brown | 220/269 |
| 4,061,243 | 12/1977 | Khoury . | |
| 4,084,721 | 4/1978 | Perry . | |
| 4,150,765 | 4/1979 | Mazurek . | |
| 4,183,445 | 1/1980 | LaCross . | |
| 4,257,529 | 3/1981 | Saunders | 220/269 |
| 4,289,251 | 9/1981 | Maliszewski | 220/269 |
| 4,320,850 | 3/1982 | Drolen, Jr. . | |
| 4,485,935 | 12/1984 | Stoffel | 220/270 |
| 4,605,141 | 8/1986 | Won . | |
| 4,804,104 | 2/1989 | Moen . | |
| 4,901,880 | 2/1990 | Tatham et al. . | |
| 5,011,037 | 4/1991 | Moen et al. . | |
| 5,064,087 | 11/1991 | Koch . | |
| 5,307,947 | 5/1994 | Moen et al. . | |

*Primary Examiner*—Allan N. Shoap
*Assistant Examiner*—Robin A. Hylton
*Attorney, Agent, or Firm*—Klaas, Law, O'Meara & Malkin, P.C.; Joseph J. Kelly

[57] ABSTRACT

A container end member has a peripheral wall and integral central end wall portion with a stay-on-tab mounted on the central end wall portion for pivotal and rotational movement and a score line groove defined by two spaced apart terminal ends formed in the central end wall portion for defining a severable panel portion that is large enough so that when severed will provide an elongated opening that vents the container to permit pouring of the beverage in the container at faster pour rates than now available.

13 Claims, 2 Drawing Sheets

DOUBLE HINGED OPENING FOR CONTAINER END MEMBERS

This application is a continuation-in-part of U.S. patent application Ser. No. 08/276,331 filed Jul. 15, 1994 for SCORE LINE GROOVE FOR CONTAINER END MEMBERS of William A. Sedgely.

FIELD OF THE INVENTION

This invention relates generally to container end members and more specifically to container end members that have a severable panel portion of a sufficient size to form a pour opening and a workable vent opening.

BACKGROUND OF THE INVENTION

U.S. Pat. No. 3,977,561 discloses a container end member having a score line groove for defining a severable panel portion that, when severed, is stated to provide an air vent in addition to the pour opening. However, the air vent is extremely small. U.S. Pat. No. 5,011,037 offers a solution to this extremely small air vent by providing a separate air vent of a substantial size to provide for proper air venting. While the '037 patent does provide the desired results, more improvements are always desirable.

BRIEF DESCRIPTION OF THE INVENTION

This invention provides a container end member having a severable panel portion defined by a score line groove so that, when the severable panel portion is severed, it provides an opening that functions both as a pour opening and an air vent opening of a desired size.

The opening is an elongated opening extending into all four quadrants of the can end. The elongated opening allows a beverage to be poured more quickly and without "gluging" (the surging and halting in the pouring of a liquid that is caused when the pouring container periodically develops a vacuum during unvented pouring) than with conventional can ends. Because of the elongated shape of the score configuration, the opening force of the end is not significantly affected even though the opening which it provides is much larger than standard openings. The new configuration does not increase the cost of production over conventional ends and in one embodiment provides the consumer with an option of forming a conventional opening or an enlarged smooth pouring opening.

In one preferred embodiment of the invention, there is provided a container end member for sealed association with a container body member to provide a sealed container. The end member has a peripheral wall portion and an integral, circular central end wall portion. Mounting means are provided and at least a portion thereof are located on a diametrical reference line of the central end wall portion for pivotally and rotationally mounting a stay-on-tab on the central end wall portion. A score line groove having spaced apart terminal ends is formed in the central end wall portion for defining a severable panel portion. A first portion of the score line groove passes over the diametrical reference line on one side of the mounting means at a location spaced a remote distance from the center of the mounting means and a second portion of the score line groove passes over the diametrical reference line on the opposite side of the mounting means at a location spaced a remote distance from the center of the mounting means so that the mounting means are located between the first and second portions. A third portion of the score line groove passes over the diametrical reference line on the one side of the mounting means so that the third portion is located between the first portion and the mounting means. If desired, the at least a portion of the mounting means can be located on a chorded reference line of the central end wall portion. The remote distance is preferably at least 0.25 of the radius of the central end wall portion. Another diametrical or chordal reference line of the central end wall portion passes over the diametrical or chordal reference line and divides the central end wall portion into four sections. At least a portion of the score line groove is located in each of the four sections. If the another diametrical reference line is perpendicular to the diametrical reference line, the sections are quadrants. The spaced apart terminal ends are located in different quadrants. In another preferred embodiment the spaced apart terminal ends are located in the same quadrant.

BRIEF DESCRIPTION OF THE DRAWINGS

Illustrative and presently preferred embodiments of the invention are illustrated in the drawings in which.

DETAILED DESCRIPTION OF THE INVENTION

Figure 1:
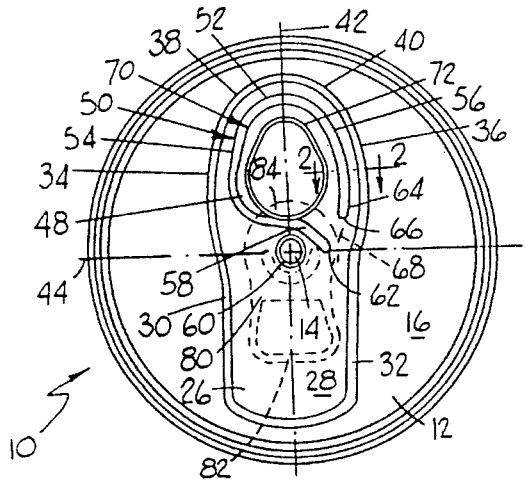
FIG. 1 (PRIOR ART)
FIG. 1 is a top plan view of a container end member of the prior art.

In FIG. 1, there is illustrated a prior art container end member 10, such as that described in U.S. Pat. No. 4,901,880, which is incorporated herein by reference thereto, formed from a blank of sheet material such as, for example, an aluminum alloy of approximately 0.0108 inch in thickness having a circular central end wall portion 12 and a central axis 14, to provide an outer surface 16 and an inner surface (not shown) when the container end member 10 is used with a container body (not shown). The central end wall portion 12 is axially inwardly off-set from an annular peripheral wall portion 20 having an axially outwardly facing end surface 22 and integrally connected to a generally radially inwardly directed flange portion 24 which is also integral with the central wall portion 12.

A generally rectangularly shaped, axially inwardly depressed panel portion 26 is formed in the central end wall portion 12 and extends downwardly in an axially inward direction from the central end wall portion 12. The depressed panel portion 26 has a flat inclined outer end portion 28, two spaced apart generally parallel elongated axially inwardly inclined side edge portions 30 and 32 and two spaced apart curved, axially inwardly inclined edge portions 34 and 36 having central end portions 38 and 40.

The container end member 10 has a first diametrical reference line 42 and a second diametrical reference line 44.

A severable panel portion 48 is located generally between the curved edge portions 34 and 36. The configuration of the severable panel portion 48 is defined by an outer score line groove 50 in the outer surface 16 of the depressed panel portion 26. The outer score line groove 50 has an arcuate portion 52 extending across the first diametrical reference line 42 and located adjacent to the end portions 38 and 40 of the depressed panel portion 26, a pair of spaced curved side portions 54 and 56 on opposite sides of the first diametrical reference line 42. The curved side portion 54 has a terminal end portion 58 extending across the first diametrical reference line 42 and located a relatively small distance form a portion of the periphery of a central rivet 60, and having a terminal end portion 62. The curved side portion 56 has a terminal end portion 64 having a terminal end 66. The arcuate portion 52 and curved side portions 54 and 56 comprise the main body portion of the outer score line groove 50. An integral hinge portion 68 extends between the terminal end portion 62 and the terminal end 66. An inner score line groove 70, which is an insurance score line groove, has a configuration slightly smaller than the outer score line groove 50. The depth of the inner score line groove 70 is substantially less than the depth of the outer score line groove 50. The depth of the score line groove is expressed by the score residual, which is the material remaining in the groove, and for score line groove 50 the score residual varies between about 0.0030 to 0.0036 inch and for the score line groove 70, the score residual is about 0.0066 inch. A closed reinforcing rib 72 extends in an axially outward direction from the severable panel portion 48 and has a configuration similar to a portion of but slightly smaller than the inner score line groove means 70.

The terminal end 66 is semi-circular having a radius of about 0.0025 inch. The depth of the inner score line groove 70 begins to get deeper at the start 74 of the semi-circle and reaches the depth of the outer score line groove 50 at a tangent 76 to the middle of the semi-circle. The terminal end portion 58 and terminal end 62 are similarly formed.

A stay-on-tab 80 is secured to the rivet 60 for pivotal and rotational movement and has one end portion 82 adapted to be contacted by a finger of an user and another end portion 84 adapted to contact the severable panel portion 48 and apply an axially inwardly directed force thereto.

Figure 2:
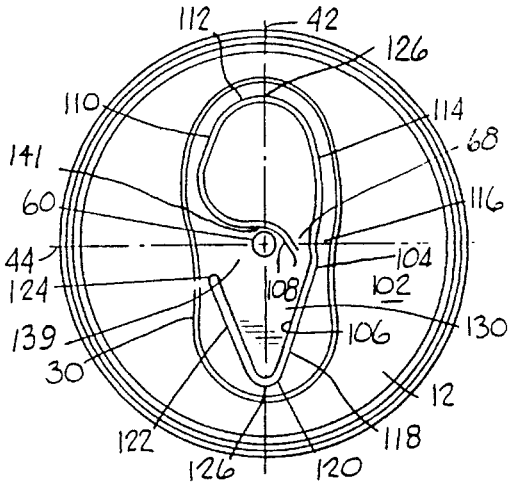
FIG. 2 is a top plan view of one embodiment of a container end member of this invention with the stay-on-tab not shown.

In FIG. 2, there is illustrated one preferred embodiment of a container end member 102 which is the same as the container end member 10 except for the shapes of the score line groove 104 and the inner score line groove 106 so that, in most instances, corresponding parts have been given the same reference numerals. The score line groove 104 has a terminal end portion 108, similar to terminal end portion 58, that crosses the second diametrical reference line 44 and the first diametrical reference line 42 at a relatively small distance from the central rivet 60. The score line groove 104 has a curved side portion 110, similar to the curved side portion 54, an arcuate portion 112 that crosses the first diametrical reference line 42 at a location remote from the central rivet 60 and a curved side portion 114, similar to the curved side portion 56, but does not terminate at 66. The score line groove 104 continues and crosses the second diametrical reference line 44 at 116 and has a side portion 118, an arcuate portion 120 that crosses the first diametrical reference line 42 and a side portion 122 that ends at the terminal end portion 124. If the rivet 60 is to be located off center of the circular end wall portion 12, then the diametrical reference lines 42 and 44 would be chord reference lines.

In order to gain the advantages of this invention, the distance between the center of the central rivet 60 and the crossing points 126 should be at least 0.25 of radius of the circular end wall portion 12. The score line groove 104 defines one severable panel portion having a pour opening portion 128 and a vent opening portion 130.

Figure 3:
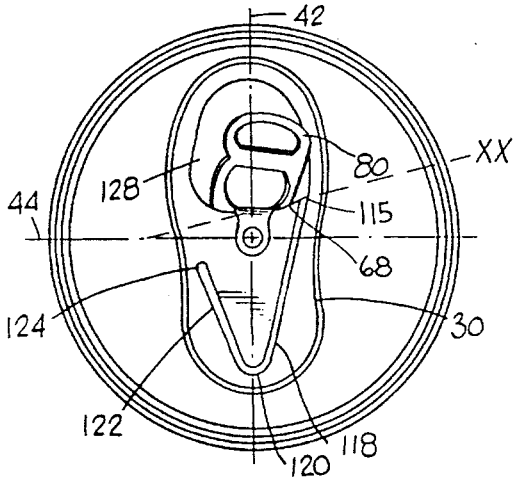
FIGS. 3–6 are schematic illustrations of one method for forming an opening in the container end member of FIG. 2.

One method of forming an opening in the container end member 102 is illustrated in FIGS. 3–6. In FIG. 3, the stay-on-tab 80 has been operated to form the pour opening 128.

The score line has been ruptured approximately to point 115 such that a severed panel portion approximately the same size and shape as that formed by the prior art end shown in FIG. 1 is caused to hinge at area 68 having hinge axis XX. Thus, a conventional opening may be formed in the end by simply moving the tab 80 back to its original position. However, an elongated enlarged opening extending into the quadrants positioned on the opposite side of diameter 44 may be provided by performing the steps shown in FIGS. 4–6 or, alternatively, FIGS. 7–9.

Figure 4:
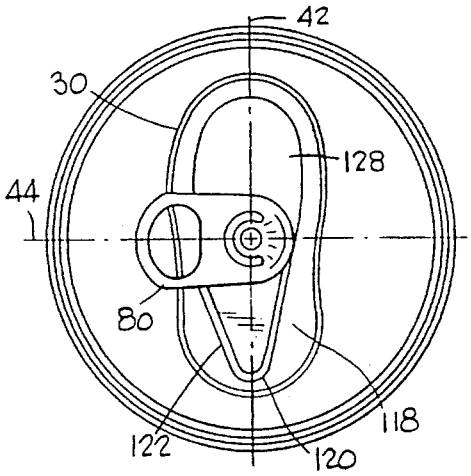
Figure 5:
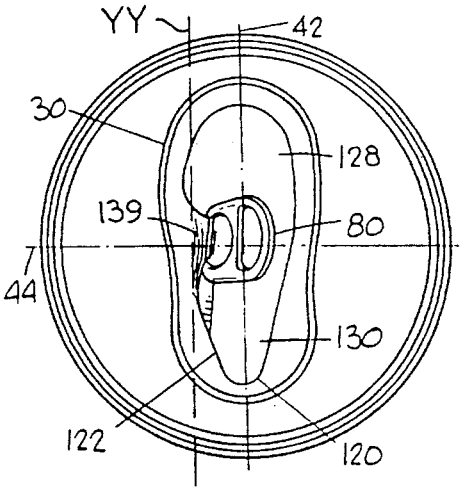
Figure 6:
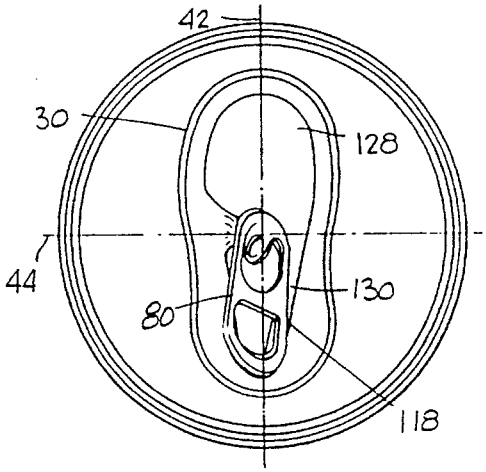

In FIG. 4, the stay-on-tab 80 has been rotated 90 degrees. In FIG. 5, the stay-on-tab 80 has been operated to form the vent opening 130. In FIG. 6, the stay-on-tab 80 has been rotated so that a portion thereof extends into the interior of the container through the vent opening 130.

Figure 7:
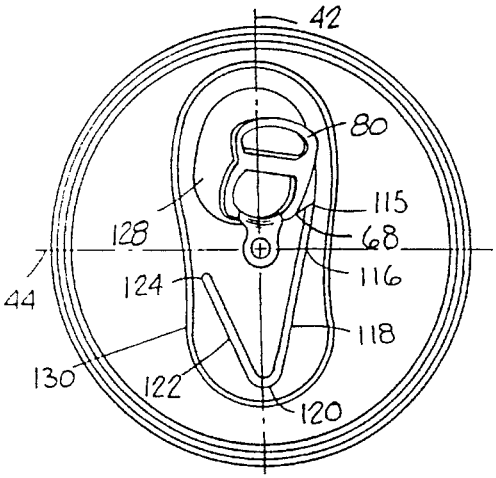
FIGS. 7–9 are schematic illustrations of another method for forming an opening in the container end member of FIG. 2.
Figure 8:
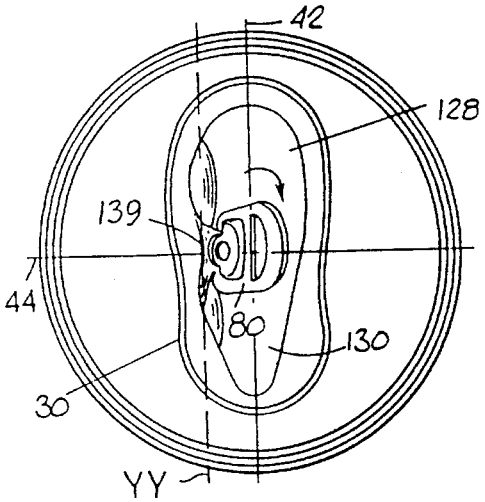
Figure 9:
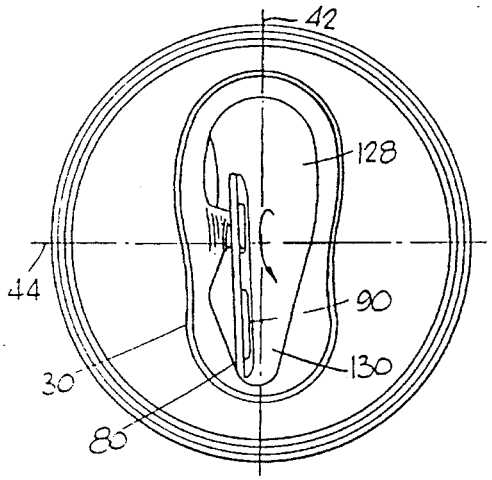

Another method of forming an opening in the container end member 102 is illustrated in FIGS. 7–9. In FIG. 7, the stay-on-tab 80 has been operated to form the pour opening 128. The stay-on-tab 80 is then rotated about an axis with one end portion extending into the interior of the container to form the vent opening 130 as illustrated in FIG. 8. In FIG. 9, the stay-on-tab 80 has been rotated so that a portion thereof extends into the interior of the container through the vent opening 130. In both the opening method of FIGS. 4–6 and that of FIGS. 7–9, the first hinge region 68 ceases to act as a hinge and becomes a portion of the severed panel and hinging takes place in a new hinge region 139 about a hinge axis YY approximately parallel to axis 42. In one embodiment, the metal thickness along the score line is approximately 0.0041 inches throughout its length except in region 141 where it is 0.0049 inches for a standard 68 psi/can.

Figure 10:
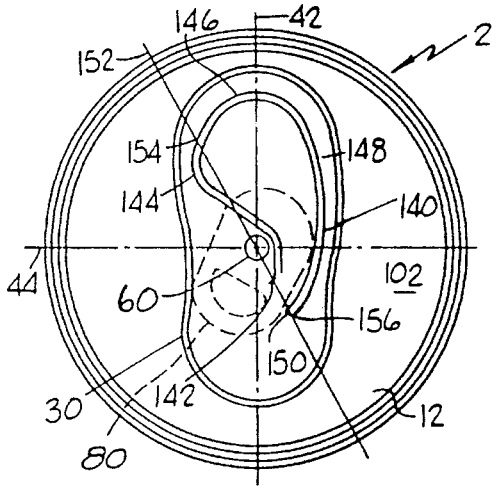
FIG. 10 is a top plan view of another embodiment of a container end member of this invention with the stay-on-tab in dashed lines.

In FIG. 10, there is illustrated another preferred embodiment of a container end member 102. A score line groove 140 has a terminal end portion 142 that crosses the second diametrical reference line 44 and the first diametrical reference line 42 at a relatively small distance from the central rivet 60. The score line groove 140 has a curved side portion 144, an arcuate portion 146 that crosses the first diametrical reference line 42 at a location remote from the central rivet 60 and a curved side portion 148. The curved side portion 148 crosses the second diametrical reference line 44 and has a terminal end portion 150. A third diametrical reference line 152 is provided. The score line groove 140 crosses the third diametrical reference line at a location 154 remote from the central rivet 60 and is spaced from the center of the central rivet 60 a distance of about 0.62 of the radius of the circular end wall portion 12 and at a location 156 remote from the central rivet 60 and is spaced from the center of the central rivet 60 a distance of about 0.48 of the radius of the circular end wall portion 12.

The score line grooves 104 and 140 are for illustration purposes only of a one and two step operation for the formation of an opening in a container end member and may be of other configurations as long as they describe a severable panel portion that is large enough to provide an adequate pour and vent opening. A stay-on tab 80 is positioned in skewed relationship with axes 42 and 44.

Figure 11:
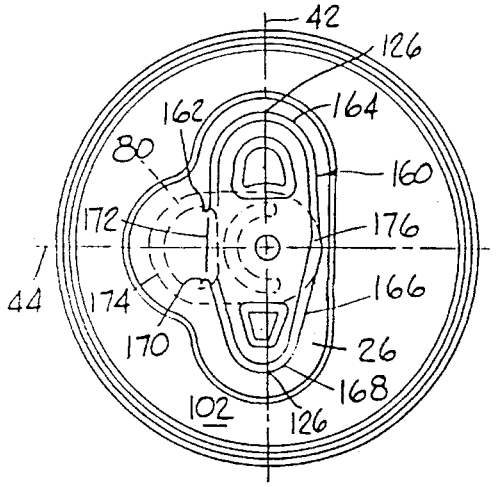
FIG. 11 is a top plan view of another embodiment of the invention.
Figure 12:
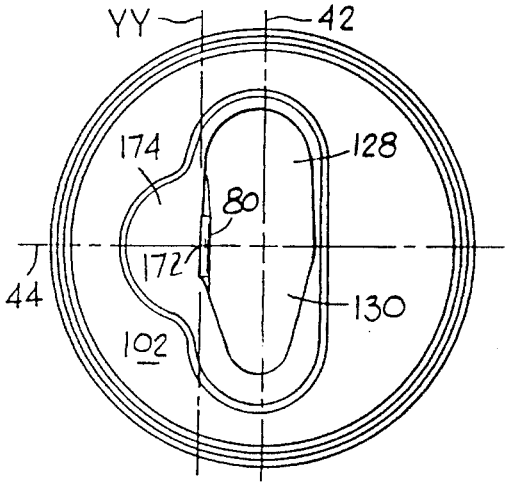
FIG. 12 is a top plan view of FIG. 11 after the pour and vent openings have been formed.

Another preferred embodiment of the invention is illustrated in FIGS. 11 and 12. A score line groove 160 has a curved terminal end portion 162, an arcuate portion 164 that crosses the diametral line 42 at 126, a relatively long curved portion 166, another arcuate portion 168 that crosses the diametral line 42 at 126 and another curved terminal end portion 170. A hinge score line 172 extends between but is slightly spaced from the terminal end portions 162 and 170. While the use of the hinge score line 172 is preferred, since it allows the stay-on-tab 80 to be located in a better position, the benefits of the invention may still be obtained without it. The axially inwardly depressed panel portion 26 has been modified so as to have a portion 174 to accomodate the finger engaging portion of the stay-on-tab 80 as illustrated at the nine o'clock position on FIG. 11. The end 176 of the stay-on-tab 80 overlies a portion of the relatively long curved portion 166. As stated above, the score residual of the score line groove 160 varies between 0.0030 and 0.0036 inch. The portion of the relatively long curved portion 166 beneath the end 176 has a score residual of about 0.0030 inch and before and after that portion, the score residual is about 0.0036. The score residual of the arcuate portions 164 and 168 is about 0.0030 inch. The score residual of hinge score line 172 is at least about 0.0050 inch.

In operation, a finger tip is placed under the portion of the stay-on-tab 80 in the portion 174 and an upward force moves the end 176 downwardly to initiate the tear of the score line groove 160. As illustrated in FIG. 11, the movement of the stay-on-tab 80 is continued until the pour opening 128 and the vent opening 130 have been formed. In some instances, the stay-on-tab 80 may be located and operated as described above in relation to FIGS. 2–9.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A container end member for sealed association with a container body member to provide a sealed container comprising:

a container end member having a peripheral wall portion and an integral, central end wall portion;

a stay-on-tab;

mounting means for pivotally and rotationally mounting said stay-on-tab on said central end wall portion;

a score line groove defined between two spaced apart terminal ends formed in said central end wall portion for defining a severable panel portion;

said stay-on-tab having one end portion for applying a force on said severable panel portion to move said severable panel portion into said container;

said severable panel portion having a size that requires the application of force by said one end portion on at least two spaced apart locations of said severable panel portion to pivot said severable panel portion around a first hinge to open partially said severable panel portion and then to pivot said severable panel portion around a second hinge to sever completely said score line groove;

said second hinge retaining said stay-on-tab on said container end member;

said first hinge being adjacent one terminal end of said score line groove, the second hinge being adjacent the second terminal end of said score line groove and said first and second hinges being spaced apart.

2. A container end member for sealed association with a container body member to provide a sealed container comprising:

a container end member having a peripheral wall portion and an integral, circular central end wall portion;

a stay-on-tab;

mounting means having at least a portion thereof located on a chord of said central end portion for pivotally and rotationally mounting said stay-on-tab on said central end portion;

a score line groove defined between two spaced apart terminal ends formed in said central end wall portion for defining a severable panel portions;

a first portion of said score line groove passing over said chord on one side of said mounting means at a distance that is remote from said mounting means;

a second portion of said score line groove passing over said chord on the other side of said mounting means at a distance that is remote from said mounting means so that said mounting means are located between said first and second portions;

a third portion of said score line groove passing over said chord on said one side of mounting means and adjacent to said mounting means so that said third portion is located between said first portion and said mounting means;

a first hinge located between one of said spaced apart terminal ends and a of said score line groove; and a second hinge portion located between the other of said spaced apart terminal ends and another portion of said score line groove.

3. A container end member for sealed association with a container body member to provide a sealed container comprising:

a container end member having a peripheral wall portion and an integral, circular central end wall portion;

a stay-on-tab;

mounting means having at least a portion thereof located on a chord of said central end wall portion for pivotally and rotationally mounting said stay-on-tab on said central end wall portion;

a score line groove defined between two spaced apart terminal ends formed in said central end wall portion for defining a severable panel portion;

a first portion of said score line groove passing over said chord on one side of said mounting means at a location spaced from the center of said mounting means a distance equal to at least 0.25 of the radius of said central end wall portion; .

a second portion of said score line groove passing over said chord on the opposite side of said mounting means at a location spaced from the center of said mounting means a distance equal to at least 0.25 of the radius of said central end wall portion;

a third portion of said score line groove passing over said chord on said one side of said mounting means so that said third portion is located between said first portion and said mounting means;

a first hinge located between one of said spaced apart terminal ends and a portion of said score line groove; and a second hinge located between the other of said terminal ends and another portion of said score line groove.

4. A container end member as in claim 3 wherein:

said score line groove is continuous between said first, second and third portions.

5. A container end member as in claim 3 and further comprising:

another chord of said central end wall portion passing over said chord dividing said central end wall portion into four sections; and at least a portion of said score line groove located in each of said four sections.

6. A container end member as in claim 5 and further comprising:

said spaced apart terminal ends being located in different sections.

7. A container end member as in claim 5 wherein said another chord is perpendicular to said chord.

8. A container end member as in claim 3 wherein:

said chord is a diameter.

9. A container end member as in claim 8 wherein:

said score line groove is continuous between said first, second and third portions.

10. A container end member as in claim 8 and further comprising:

another chord passing over said diameter and dividing said central end wall portion into four sections; and at least a portion of said score line groove is located in each of said four sections.

11. A container end member as in claim 10 wherein:

said another chord is a diameter.

12. A container end member as in claim 11 wherein:

each of said sections is a quadrant.

13. A container end member as in claim 12 and further comprising:

said two spaced apart terminal ends being located in different quadrants; and at least a portion of said score line groove in each of said quadrants being arcuate.

* * * * *